US007059951B2

(12) United States Patent
Nakano et al.

(10) Patent No.: US 7,059,951 B2
(45) Date of Patent: Jun. 13, 2006

(54) POLISHING PAD, METHOD OF MANUFACTURING GLASS SUBSTRATE FOR USE IN DATA RECORDING MEDIUM USING THE PAD, AND GLASS SUBSTRATE FOR USE IN DATA RECORDING MEDIUM OBTAINED BY USING THE METHOD

(75) Inventors: Hiromi Nakano, Osaka (JP); Hirokazu Tajima, Osaka (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 11/182,296

(22) Filed: Jul. 15, 2005

(65) Prior Publication Data

US 2005/0250424 A1 Nov. 10, 2005

Related U.S. Application Data

(62) Division of application No. 10/807,670, filed on Mar. 24, 2004, now Pat. No. 6,932,677.

(30) Foreign Application Priority Data

Mar. 28, 2003 (JP) ..... 2003-091125

(51) Int. Cl.
*B24D 11/00* (2006.01)

(52) U.S. Cl. ..... 451/533; 451/530

(58) Field of Classification Search ..... 451/526, 451/527, 530, 533, 539
See application file for complete search history.

(56) References Cited

U.S. PATENT DOCUMENTS

| | | | | |
|---|---|---|---|---|
| 6,117,000 | A * | 9/2000 | Anjur et al. | 451/526 |
| 6,126,532 | A * | 10/2000 | Sevilla et al. | 451/526 |
| 6,439,965 | B1 * | 8/2002 | Ichino et al. | 451/36 |
| 6,736,705 | B1 | 5/2004 | Benning et al. | |
| 6,749,487 | B1 * | 6/2004 | Okuhata et al. | 451/41 |
| 2003/0109202 | A1 | 6/2003 | Matsuno et al. | |
| 2003/0110803 | A1 | 6/2003 | Saito et al. | |
| 2004/0180611 | A1 * | 9/2004 | Tajima et al. | 451/41 |
| 2006/0002283 | A1 * | 1/2006 | Horisaka et al. | 369/272.1 |

FOREIGN PATENT DOCUMENTS

JP 2000-288922 10/2000

* cited by examiner

*Primary Examiner*—Dung Van Nguyen
(74) *Attorney, Agent, or Firm*—Marsh Fischmann & Breyfogle LLP

(57) ABSTRACT

A polishing pad used for precise polishing of the surface of a lapped glass workpiece when a glass substrate for use in data recording media is manufactured from a glass workpiece. The polishing pad comprises a base and a polishing portion laminated on the base and contacting the surface of the glass workpiece at the time of polishing. The polishing portion is formed of a foam made of a synthetic resin having a 100% modulus of 11.8 MPa or less. A type of parameter representing the surface roughness of the polishing portion, namely, the maximum height (Rmax), is 70 μm or less.

4 Claims, 1 Drawing Sheet

POLISHING PAD, METHOD OF MANUFACTURING GLASS SUBSTRATE FOR USE IN DATA RECORDING MEDIUM USING THE PAD, AND GLASS SUBSTRATE FOR USE IN DATA RECORDING MEDIUM OBTAINED BY USING THE METHOD

CROSS-REFERENCE TO RELATED APPLICATIONS

This application is a divisional of U.S. patent application Ser. No. 10/807,670 filed Mar. 24, 2004, now U.S. Pat. No. 6,932,677 which claims priority from Japanese Patent Application No. 2003-091125 filed Mar. 28, 2003, both applications are hereby incorporated by reference in their entirety as if set forth herein in full.

BACKGROUND OF THE INVENTION

The present invention relates to a polishing pad used in manufacturing magnetic disks for magnetic recording media in information recording devices such as hard disks, magneto-optic disks, and optical disks, a method of manufacturing glass substrates for use in data recording media by using the pad, and a glass substrate for use in data recording media obtained by the method.

Conventionally, magnetic disks, which are one type of data recording media, are used in hard disk drive devices. Such magnetic disks are manufactured by laminating magnetic layers on the surface of glass substrates for use in data recording media (hereinafter referred to as glass substrates). In this connection, a magnetic head for reading information recorded on a magnetic disk (hereinafter sometimes referred to as a head) moves relative to the magnetic disk in a manner floating above and away from the surface of the magnetic disk.

When the head moves, if there are asperities on the surface of the magnetic disk, the head comes into contact with the asperities, so that there possibly occurs a problem in that the head is damaged and/or the magnetic disk scratched. Additionally, current magnetic disks are required to have increased memory capacity, and in order to meet this requirement, it is necessary to enhance the recording density by narrowing to a possible extreme the spacing between the surface of the magnetic disk and the head. Accordingly, glass substrates for magnetic disks are subjected to polishing treatment, and in this connection, an attempt has been made for improving the surface flatness for the purpose of suppressing the generation of surface asperities (for example, see Japanese Laid-Open Patent Publication No. 2000-288922).

In the above described polishing treatment, a polishing apparatus equipped with a polishing carrier and a polishing pad is used; when performing polishing treatment, the polishing pad is brought into contact with the surface of the glass substrate under the condition such that the glass substrate is accommodated on a polishing carrier, the glass substrate and the polishing pad are made to mutually rotate, and thus the surface of the glass substrate is polished.

Now, when a glass substrate manufactured by use of the above described polishing pad fails to meet the required qualities, the pad is regarded to have reached its durability limit and accordingly replaced with a new polishing pad. Conventionally, there has been selected a polishing pad having hardness in compliance with the purposes involving the carrier hardness, glass substrate hardness and the like, by referring to the Asker C hardness specified in the standard SRIS-0101 of the Society of Rubber Industry, Japan. According to the selected pad, the quality required for the glass substrate and the replacement timing of the polishing pad are determined. The polishing pad is composed of a base made of nonwoven fabric and a polishing portion made of synthetic resin foam and laminated on the surface of the base for contact with the surface of a glass substrate. However, the Asker C hardness is the hardness obtained by measurement of the polishing pad, after the base and the polishing portion have been laminated together, but is not the hardness obtained by measurement only of the polishing portion that is actually for contact with the surface of a glass workpiece.

More specifically, the polishing pad selected on the basis of the Asker C hardness does not involve consideration of the time variation of the polishing portion thereof. Thus, according to the polishing pad selected on the basis of the Asker C hardness, the time variation of the polishing portion leads to a fear of causing a problem including the possibility such that the quality of the manufactured glass substrate is not stabilized and the polishing pad must be frequently replaced. Because of a fear of causing such a problem, there has been a problem such that it is difficult to increase the manufacturing quantity while maintaining the process yield of the glass substrate with stable quality.

SUMMARY OF THE INVENTION

The present invention was made by focusing attention on such problems as described above, involved in the prior art. The present invention has as its object the provision of a polishing pad which can promote increasing the manufacturing quantity of the glass substrate for use in data recording media while maintaining the process yield of the glass substrate with stable quality and a method of manufacturing the glass substrate for use in data recording media by using the polishing pad. The present invention also has as another object the provision of the glass substrate for use in data recording media, while maintaining the process yield with stable quality.

To achieve the foregoing and other objectives and in accordance with the purpose of the present invention, a polishing pad for precise polishing of the surface of a lapped glass workpiece for use in data recording media is provided. The polishing pad comprising includes a base and a polishing portion laminated on the surface of the base and contacting the surface of the glass workpiece when polishing the glass workpiece. The polishing portion is formed of a foam made of a synthetic resin having a 100% modulus of 11.8 MPa or less. The maximum height, Rmax, of the surface roughness of the polishing portion, is 70 μm or less.

The present invention also provides a method for manufacturing a glass substrate for use in data recording media in which a polishing pad is used. The method includes: contacting the surface of a lapped glass workpiece with the polishing pad with a load of 35 to 70 gf/cm$^2$ on the lapped glass workpiece; and polishing the lapped glass workpiece over a polishing period time in units of minute such that the product between the polishing period of time and the load in units of gf/cm$^2$ is 160 or more.

Further, the present invention provides another method for manufacturing a glass substrate for use in data recording media. The method includes: lapping a glass workpiece by use of a hard pad and a polishing agent containing particles of about 1.2 μm in average particle size; and polishing the glass workpiece obtained in the lapping by use of a soft pad and a polishing agent containing particles of about 0.6 μm in average particle size.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
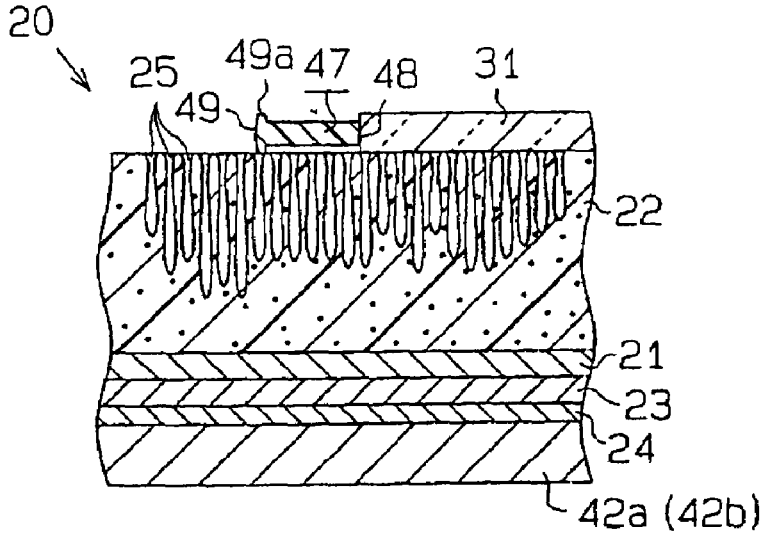
FIG. 1 is a schematic sectional view illustrating an enlarged part of a soft pad.

Detailed description will be made below of the embodiments of the present invention on the basis of the accompanying drawings.

A glass substrate for use in data recording media is formed in a circular shape, with a circular hole in the center thereof, and is used as a substrate for data recording media including such types as a magnetic disk, magneto-optic disk and optical disk. Examples of materials for forming the glass substrate include soda lime glass, alumino silicate glass, borosilicate glass and crystallized glass. By laminating a magnetic layer or the like on the surface of the glass substrate, a data recording medium is constructed and the surface thereof becomes the information recording portion of the data recording medium.

A data recording medium is used to achieve high density recording by reducing the distance between the information recording portion and the head for reading the information recorded on the data recording medium. When the distance between the information recording portion and the head is reduced, if there are asperities on the surface of the glass substrate, there also come to be formed asperities on the information recording portion. Thus, there is a fear of causing a problem such that the asperities possibly contact or interfere and thus block accurate reading of the recorded information, damage the head, and/or scratch the information recording portion. Accordingly, the glass substrate is suppressed in generating asperities by subjecting a glass workpiece, which is the material for the glass substrate, to a high precision polishing treatment to make the surface thereof flat and smooth.

Now, a description will be provided of the asperities of the surface of the glass substrate. Actual observation of the condition of the surface of a glass substrate reveals that on the surface are found waviness caused by strain, bending and warping of the glass workpiece, by the mechanical strain and polishing stress caused by polishing, and by some other causes, and additionally, micro-waviness is also found to be generated on the waviness of the glass substrate. Additionally, on the surface of the glass substrate, there are generated micro asperities other than the waviness and the micro-waviness. Owing to this waviness, micro-waviness and micro asperities, there are various sizes of asperities on the surface of the glass substrate.

In the following descriptions, among the asperities on the surface of the glass substrate, the asperities specified by JIS B0601-1994, more specifically, the asperities measured by means of an atomic force microscope (AFM) will be represented by the roughness average (Ra). By using a multi-functional desk top interferometer (OPTIFLAT) manufactured by Phase Shift Technology, Inc., with the measurement wavelengths (λ) ranging from 0.4 to 5.0 mm, a specified portion of the surface is scanned with white light to measure the asperities, and the asperities thus measured are defined as waviness (Wa). Additionally, by using a three dimensional surface structure analysis microscope (NewView 200) manufactured by Zygo Corp., with the measurement wavelengths (λ) ranging from 0.18 to 0.40 mm, a specified portion of the surface was scanned with white light to measure the asperities, and the asperities thus measured are defined as micro-waviness (NRa).

In the glass substrate concerned, the roughness average Ra is preferably 0.4 nm or less. When the roughness average Ra is larger than 0.4 nm, there are a large number of asperities generated, the surface becomes rough, the movement of the head becomes unstable, and eventually the above described problems occur. When the arithmetic mean roughness is 0.4 nm or less, the glass substrate is sufficiently high in quality, but when the quality of the glass substrate is made to have further higher recording density, the roughness average Ra is preferably smaller. Accordingly, the arithmetic mean roughness is preferably less than 0.2 nm. The waviness Wa is preferably 0.8 nm or less. When the waviness Wa is higher than 0.8 nm, micro-waviness also becomes higher with increasing waviness, possibly leading to a fear of making stable movement of the head impossible above the surface of the glass substrate. When the waviness Wa is 0.8 nm or less, the glass substrate is sufficiently high in quality, but when a further higher quality of glass substrate is required, the waviness Wa is preferably smaller. Accordingly, the waviness Wa is more preferably 0.5 nm or less, further more preferably 0.4 nm or less.

The micro-waviness NRa is preferably 0.3 nm or less. When the micro-waviness NRa is higher than 0.3 nm, the micro-waviness becomes large and hence there is a fear of generating with high probabilities the problems caused by the collision or interference of the head due to the micro-waviness. When the micro-waviness NRa is 0.3 nm or less, the glass substrate is sufficiently high in quality, but when a further higher quality of glass substrate is required, the micro-waviness NRa is preferably smaller. Accordingly, the micro-waviness NRa is more preferably 0.2 nm. With a glass substrate formed for the roughness average Ra, waviness Wa and micro-waviness NRa values to fall respectively within the above described ranges, the floating height (hereinafter abbreviated as HTO) of the head from the surface of the substrate is preferably 4.5 nm or less. When the HTO is higher than 4.5 nm, it becomes difficult to achieve high density recording. No particular constraint is imposed on the lower limit of HTO, but the lower limit is 0 nm because the lower HTO is the more preferable.

In the next place, the method for manufacturing the above described glass substrate will be described below.

The glass substrate is manufactured as follows: a circular glass workpiece is cut out from a sheet-shaped glass plate and the outside dimension and the inside dimension of the plate are made to satisfy the predetermined dimensions, and thereafter, the surface of the glass workpiece is subjected to a polishing treatment separated into many steps to yield a glass substrate. The polishing treatment is broadly separated into two stages of polishing steps and each polishing step is used in a batch type polishing apparatus for polishing plural sheets of glass workpieces simultaneously.

Now, description will be provided below on the configuration of the batch type polishing apparatus.

Figure 2:
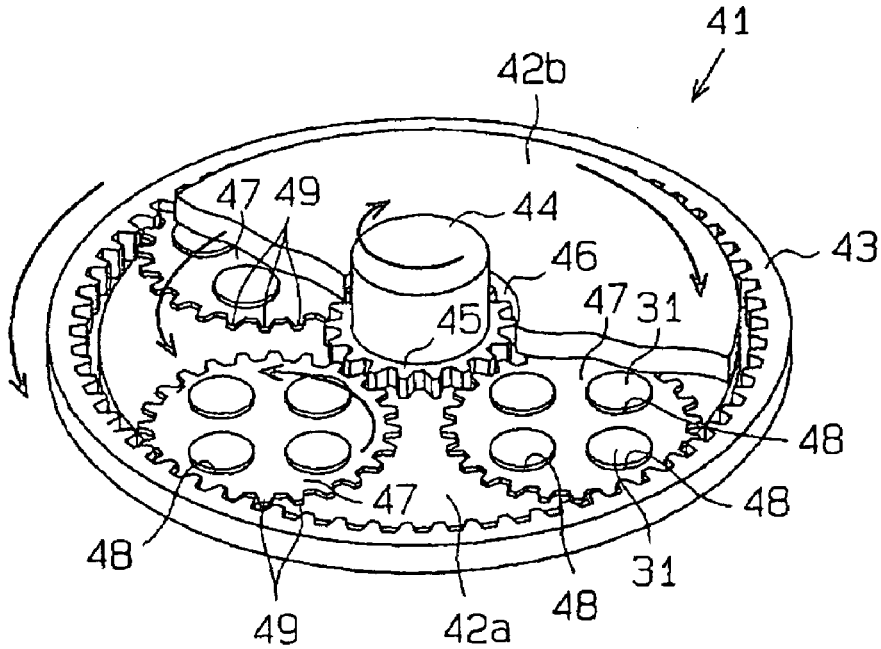
FIG. 2 is a partially cutaway, oblique perspective view of a batch type polishing apparatus.

As FIG. 2 shows, a polishing apparatus 41 comprises a disk-shaped upper platen 42*b* and a disk-shaped lower platen 42*a* arranged parallel to each other with a certain vertical spacing therebetween, and a circular internal gear 43 arranged so as to confine the upper platen 42*b* and the lower platen 42*a* in the interior of the gear. A rotary shaft 44 is provided in a protruding condition at the center of the lower platen 42*a*, and a sun gear 45 is provided on the outer circumferential surface of the lower end of the rotary shaft 44. An insertion through hole 46 is provided in at the center of the upper platen 42*b*, and the rotary shaft 44 is made to pass through the insertion through hole 46. The upper platen 42*b*, the lower platen 42*a*, the internal gear 43 and the sun gear 45 are driven by a motor or the like so as to be independently rotatable.

Plural carriers 47 are provided between the lower platen 42*a* and the upper platen 42*b* in a manner sandwiched between the platens. Each of the carriers 47 is provided with plural circular holes 48, and a glass workpiece 31 is accommodated in each of the circular holes 48. A gear 49 is formed on the outer circumferential portion of each of the carriers 47, and the gear 49 of each of the carriers 47 is made to engage respectively with the above described internal gear 43 and sun gear 45.

When the polishing treatment is performed, the polishing apparatus 41 sandwiches the carriers 47 between the lower platen 42*a* and the upper platen 42*b* in a condition such that plural sheets of glass workpieces 31 are accommodated in each of the carriers 47. Thereafter, while supplying a polishing agent into the gap between the lower platen 42*a* and the glass workpieces 31 and the gap between the upper platen 42*b* and the glass workpieces 31, the upper platen 42*b*, the lower platen 42*a*, the internal gear 43 and the sun gear 45 are respectively made to rotate. Thus, the carriers 47 are made to rotate, between the lower platen 42*a* and the upper platen 42*b*, on the respective axes and to revolve about the rotary shaft 44 as the revolution center, under the condition such that the glass workpieces 31 are made to be in contact with the lower platen 42*a* and the upper platen 42*b*, the surfaces of the glass workpieces 31 being thereby polished.

At the beginning, the glass workpieces 31 are subjected to surface lapping in the first stage polishing step of the polishing treatment by means of the above described polishing apparatus. In the first stage polishing step, hard pads are adhered as polishing pads respectively onto the surfaces of the lower platen 42*a* and the upper platen 42*b*, these hard pads are made to slide in contact with the surfaces of the glass workpieces, and consequently the glass workpieces are lapped. The lapped glass workpieces are polished to a predetermined thickness in such a way that macro defects such as waviness, chipping and cracking are eliminated, the surface condition thereby being made to be satisfactory to some extent.

In the first stage polishing step, a slurry-like agent in which particles of about 1.2 μm in average particle size are dispersed in water is used as the polishing agent. Examples of the particle material include alumina abrasive, rare earth oxides including cerium oxide and lanthanum oxide, zirconium oxide, manganese dioxide, aluminum oxide, and colloidal silica. Among these materials, rare earth oxides are preferable because of excellent polishing efficiency, and cerium oxide is more preferable among the rare earth oxides. This is because cerium oxide chemically acts on glass materials and can thereby polish the surface of the glass materials more effectively and efficiently.

The above described hard pad is formed of a synthetic resin foam which has a hardness (JIS A) specified by JIS K6301 of 65 to 85 and a compressive elasticity modulus of 60 to 65%, and is adhered to the surfaces of the lower platen 42*a* and upper platen 42*b* so as for the compressibility ratio to be 2 to 4%. When the hardness is less than 65, the compressive elasticity modulus is higher than 65% or the compressibility ratio is higher than 4%, there is a fear that the hard pad will be deformed at the time of polishing, and thereby waviness will be formed on the surfaces of the glass substrates. Additionally, when the hardness (JIS A) is larger than 85, the compressive elasticity modulus is smaller than 60%, or the compressibility ratio is smaller than 2%, there is a fear that the hard pads will scratch the surface of the glass workpieces, and hence the surface condition of the glass workpieces will be rougher.

The amount of grinding in the first stage polishing step is preferably 30 to 40 μm. When the amount of grinding is less than 30 μm, there is a possibility that the condition of the surface cannot be made satisfactory. On the other hand, even if polishing is made to exceed the amount of grinding of 40 μm, no further improvement of the surface conditions can be achieved, and the polishing time period is lengthened, leading to a fear of lowering the manufacturing efficiency.

The glass workpiece subjected to the first stage polishing step as described above is subjected to precise polishing of the surface thereof in the second stage polishing step, which is the final stage of the polishing treatment. In the second stage polishing step, soft pads are adhered as the polishing pads respectively onto the surfaces of the lower platen 42*a* and the upper platen 42*b* of the polishing apparatus, and the soft pads are made to slide in contact with the surfaces of the glass workpieces, such that the glass workpieces are polished precisely. The precisely polished glass workpiece are made to have satisfactory surface conditions by removing defects such as waviness and micro-waviness that cannot be eliminated by the lapping, and additionally polishing stress remaining on the surface of the glass workpiece in the lapping, polishing flaws formed in the lapping, and the like are removed. The glass workpieces subjected to the second stage polishing step are finally subjected to a washing treatment to remove adhering materials such as the polishing powder, polishing agent and powder dust adhered onto the surface of the glass workpiece, and thus the glass substrates are manufactured.

In the above described precise polishing, a slurry-like polishing agent is used in which particles of about 0.6 μm (falling in the range 0.6 μm±0.1 μm) in average particle size are dispersed in water. Examples of the particle material include rare earth oxides such as cerium oxide and lanthanum oxide; zirconium oxide; manganese dioxide; aluminum oxide; and colloidal silica. Among these materials, cerium oxide, a rare earth oxide, and colloidal silica offer excellent polishing efficiency and hence are more preferable as the particle materials for the polishing agents used in the precise polishing treatment.

The soft pad contains a synthetic resin foam which has a hardness (Asker C) specified by SRIS-0111 of 58 to 78 and a compressive elasticity modulus of 58 to 78%, and is used to achieve a compressibility ratio of 1 to 5%. When the Asker C hardness is smaller than 58, the compressive elasticity modulus is higher than 78% or the compressibility ratio is higher than 5%, there is a fear that the soft pad will be deformed at the time of polishing, and thereby micro-waviness will be formed on the surface of the manufactured glass substrates. Additionally, when the Asker C hardness is larger than 78, the compressive elasticity modulus is smaller than 58%, or the compressibility ratio is smaller than 1%, there is a fear that the soft pad will scratch the surfaces of the glass substrates, and hence the surface condition of the glass substrates will be rougher.

The amount of grinding in the precise polishing stage is preferably 0.5 to 10 μm. When the amount of grinding is less than 0.5 μm, there is a fear that waviness, micro-waviness, polishing stress, polishing flaws and the like cannot be sufficiently removed, and additionally the surface conditions of the glass workpieces cannot be made satisfactory. On the other hand, even if polishing is made to exceed the amount of grinding of 10 μm, no further improvement of the surface conditions can be achieved, and the polishing time period of is lengthened, leading to a fear of lowering the manufacturing efficiency.

Now, a detailed description will be made of the above described soft pad.

As FIG. 1 shows, a base 21 constituting a soft pad 20 is formed of a nonwoven fabric made of a synthetic resin and the surface thereof is laminated with a polishing portion 22 made of a synthetic resin foam. On the back side of the base 21, a primer 23 and an adhesive portion 24 are laminated in order from the base 21. Thus, the soft pad 20 comprises the base 21, polishing portion 22, primer 23 and adhesive portion 24.

Since the above described polishing portion 22 is formed of a synthetic resin foam, the polishing portion 22 has plural pores 25. When the precise polishing is performed, the above described polishing agent is supplied between the surface of the polishing portion 22 and the surfaces of the glass workpieces 31 accommodated in the carriers 47. Thus, the particles of the polishing agent penetrate into the pores 25 and the surface of the polishing portion 22 and the particles of the polishing agent scour the surface of the glass workpieces 31, thus the surfaces of the glass workpieces are polished.

The above described primer 23 is formed by applying a coating agent on the back side of the base 21 and allowing the coated layer to be cured, and is provided for the purpose of forming and maintaining the shape of the soft pad 20. Examples of such a coating agent include emulsions, elastomers, latex made of synthetic resins, and any of these may be selected. The above-described adhesive portion 24 is provided to adhere the soft pad 20 to the lower platen 42*a* or upper platen 42*b*. The adhesive portion 24 is formed of a pressure-sensitive adhesive based on rubber, acrylic resin or the like, and as the pressure-sensitive adhesive, adhesives either having no base or having a stretchable base may be used.

In the above described precise polishing, the gear 49 of each of the carriers 47 are made to engage with the internal gear 43 and the sun gear 45, and hence protrusions 49*a* referred to as burrs are formed on the peripheral portion of the gear 49 as a result of transformation due to aging. The protrusions 49*a* scratch the surface of the polishing portion 22, and the scratches thus formed raises the surface of the polishing portion 22, leading to generation of asperities. When such asperities are generated on the surface of the polishing portion 22, the asperities damage the glass workpieces 31 when polished, and leads to a fear that micro-waviness and the like are formed on the surfaces of the manufactured glass substrates.

Thus, when such defects come to be formed on the manufactured glass substrates with high probability, the soft pad 20 is usually regarded as having reached its durability limit and is replaced with a new soft pad 20. However, there is a possibility that the asperities on the surface of the polishing portion 22 of the soft pad 20 will be scraped away when the surfaces of the glass workpieces 31 are polished, depending on the condition under which the soft pad 20 is used. In such a case, flawless glass substrates come to be formed. In other words, the quality of the manufactured glass substrates is dependent on the individual batches in each of which plural sheets of the glass workpieces 31 are polished and is unstable over whole batches, and thus there is a fear that the desired process yield cannot be satisfied.

For the purpose of preventing problems raised by the asperities formed by such protrusions 49*a* on the surface of the polishing portion 22, a synthetic resin that has a 100% modulus of 11.8 MPa (120 kgf/cm$^2$) as defined by JIS K7113 is used as the material for the polishing portion 22. Incidentally, for the soft pad, which is a conventional polishing pad, a synthetic resin that has a 100% modulus of 12.3 to 13.7 MPa (125 to 140 kgf/cm$^2$) is mainly used. The 100% modulus is derived as follows: the strength is measured for the test specimen elongated by 100% at room temperature starting from the length of the test specimen prior to measurement, and the 100% modulus is obtained by dividing the strength thus obtained by the sectional area found at the time of the measurement.

Here, it should be noted that the 100% modulus is the value representing the hardness of the synthetic resin itself, which is to be the material for a foam, in contrast to the above described Asker C hardness obtained by measuring the hardness of the polishing portion 22 in a foam state. The higher the 100% modulus value of the synthetic resin, the harder the synthetic resin, while the lower the 100% modulus value of the synthetic resin, the softer the synthetic resin. It is presumed that the hardness of the synthetic resin as the material for the polishing portion 22 rather than the hardness of the whole polishing portion 22 affects whether or not the protrusions 49*a* scratch the surface of the polishing portion 22 as described above. This is because the protrusions 49*a* are minute and scratching caused by the protrusions 49*a* does not reach the deep interior of the polishing portion 22, but is confined within the extremely narrow range from the surface of the polishing portion 22 where the effect of the hardness of the foam is not present.

The polishing portion 22 is constructed so that the portion can fend off the protrusions 49*a* and prevent the scratching of the portion when in contact with the protrusions 49*a*, owing to the use of a soft synthetic resin lower in 100% modulus than usual as the material therefor. If the 100% modulus of the synthetic resin is higher than 11.8 MPa, the polishing portion 22 cannot fend off the protrusions 49*a* when in contact with the protrusions, and scratches are generated on the surface of the polishing portion 22, resulting in degradation of the quality of the manufactured glass substrates.

For the purpose of preventing the scratching of the surface of the polishing portion 22, the lower 100% modulus value is the more preferable; however, if the 100% modulus value is excessively low, there is a possibility that the surfaces of the glass workpieces 31 will not be sufficiently polished. Accordingly, the 100% modulus of the synthetic resin used for the polishing portion 22 is preferably 6.8 to 11.8 MPa (70 to 120 kgf/cm$^2$). A soft pad 20 constituted with a polishing portion 22 comprising a synthetic resin of 11.8 MPa or less in 100% modulus can lengthen the time period over which the durability limit thereof is reached, namely, lengthen the lifetime thereof. This is derived from the fact that the asperity generation on the surface of the polishing potion 22 is suppressed, and hence defects hardly come to be formed on the surface of the manufactured glass substrates.

Additionally, when polishing is carried out by use of the soft pad 20, the load exerted by the soft pad 20 exerted on the surface of the glass workpieces 31 is preferably 35 to 70 gf/cm$^2$ (3.4 to 6.9 kPa). When the load is lower than 35 gf/cm$^2$, there is a fear that the glass workpieces 31 are not sufficiently polished, while when the load is made to be higher than 70 gf/cm$^2$, there is a fear that defects including micro-waviness and the like will be formed on the surface of the manufactured glass substrates.

Additionally, when the load exerted by the soft pad 20 is made to fall within the above described range, the product between the polishing period of time (minutes) and the load (gf/cm$^2$) is preferably set to be 160 or more. The polishing period of time (minutes) can be set to be 15.5 or more in consideration of the product with the load (kPa). Specifically, the polishing period of time is preferably four minutes or more. When the product between the polishing period of time and the load is smaller than 160, or the polishing period of time is made to be shorter than four minutes, there is a fear that the glass workpieces 31 cannot be sufficiently polished. No particular constraint is imposed on the upper limit of the polishing period of time, but an excessively elongated polishing period of time leads to a fear that the quality is not further improved, and the quantity manufactured is lowered. Accordingly, the polishing period of time is more preferably four minutes or more and less than ten minutes.

It is preferable that the soft pad 20 be preliminarily subjected to a dressing treatment before being applied in precise polishing of the glass workpieces 31 conducted in a manner separated into respective batches. The dressing referred to here is the treatment in which the surface of the soft pad 20, namely, the surface of the polishing portion 22 is polished by use of a dressing apparatus and the surface condition is thereby made satisfactory. The dressing treatment is carried out such that the surface of the polishing portion 22 is made to have a maximum height (Rmax) of 70 μm or less as derived on the basis of the surface roughness measurement method specified in JIS B0601-1982.

When the maximum height Rmax is larger than 70 μm, particularly large convex portions are formed on the surface of the polishing portion 22, and the convex portions result in a rougher surface for the polished glass workpieces 31. Additionally, it is preferable that the dressing treatment be performed with a load of 25 to 45 gf/cm$^2$ (2.4 to 4.4 kPa) for 10 to 40 minutes. When the load is less than 25 gf/cm$^2$ or the treatment time is less than 10 minutes, there is a fear that Rmax cannot be reduced to 70 μm or less. Even if the load is larger than 45 gf/cm$^2$ or the treatment time is longer than 40 minutes, there is a fear that no further improvement can be achieved for the surface condition of the polishing portion 22 and the surface of the polishing portion 22 will be scratched.

Now, a description will be provided below on the advantages achieved by the above described embodiments.

A glass substrate for use in data recording media of the present embodiments is manufactured in such a way that the surface of the glass workpiece 31 is subjected to lapping by use of a hard pad in the first stage polishing step, and thereafter, the surface of the glass workpiece 31 is subjected to precise polishing by use of a soft pad 20 as the polishing pad in the second stage polishing step. The soft pad 20 is formed by using a synthetic resin, which is 11.8 MPa or less in the 100% modulus as specified in JIS K7113, on the polishing portion 22 for contact with the surface of the glass workpiece 31. The synthetic resin used as the material for the polishing portion 22 is softer than the usual resins, and can fend off the protrusions 49*a* even when the protrusions 49*a* formed on the gear 49 of the carrier 47 contact the polishing portion 22, so that scratch generation due to the protrusions 49*a* is suppressed.

The soft pad 20 can suppress the scratch generation over a long period of time, and accordingly defects are hardly formed on the surface of the manufactured glass substrates and the pad lifetime can be extended. Additionally, the glass substrates can be manufactured with a stabilized quality.

The dressing treatment preliminarily applied to the soft pad 20 makes the Rmax of the surface of the soft pad 20 to be 70 μm or less. In other words, no large convex portions are formed on the surface of the polishing portion 22, so that the surface condition is made satisfactory.

Thus, according to the soft pad 20 and the method of manufacturing the glass substrate by using the soft pad 20, the improvement in the manufacturing quantity of the glass substrate for use in data recording media can be promoted while maintaining the process yield with stable quality. Additionally, the manufactured glass substrates can be made to be stable in quality while the process yield thereof is maintained.

Description will be provided below of examples and comparative examples in which the above described embodiments are made to be more specific.

EXAMPLE 1

The polishing portion 22 was formed of a polyurethane having a 100% modulus of 8.83 MPa (90 kgf/cm$^2$), and thus the soft pad 20 was prepared to obtain the polishing pad of Example 1. Then, the soft pad 20 was subjected to the dressing treatment in which the Ra and Rmax values of the surface of the polishing part 22 were respectively made to be 7 μm or less and 60 μm or less. The 100% modulus was derived as follows: the strength of a specimen made of the polyurethane was measured by use of an autograph when elongated by 100% at room temperature from its length prior to measurement and the 100% modulus was obtained by dividing the strength thus obtained by the sectional area existing at the time of the measurement. The Ra and Rmax values of the surface of the polishing portion 22 were measured by means of an SE3400 manufactured by Kosaka Laboratory Ltd. under setting conditions in which the stylus diameter was 20 μmf, the measurement length was 25 mm, the measurement speed was 0.1 mm/sec, and the cut-off value was 0.8 mm.

Then, glass substrates were prepared by polishing plural sheets of glass workpieces 31 by means of the above described soft pad 20 using a polishing agent containing colloidal silica as particles (Compol manufactured by Fujimi Incorporated). Each glass workpiece 31 was made of alumino silicate glass with the sizes such that the thickness was 0.65 mm, the outside diameter was 65 mm and the inside diameter was 20 mm. For the polishing at this time, the polishing period of time was set such that the load exerted by the soft pad 20 on the glass workpieces 31 was 35 gf/cm$^2$ (3.4 kPa) and the product between the load (gf/cm$^2$) and the polishing period of time (minutes) was 300. The glass substrates obtained in this way were subjected to the NRa measurement by means of a NewView 200 manufactured by Zygo Corp., and the average NRa value was found to be 0.25 nm with an accompanying standard deviation of 0.05. The lifetime of the soft pad 20 was measured to be 200 hours.

EXAMPLE 2

The polishing portion 22 was formed of a polyurethane having a 100% modulus of 11.8 MPa, and thus the soft pad 20 was prepared to obtain the polishing pad of Example 2. Then, a soft pad which had the same Ra and Rmax values as that in Example 1 was obtained without applying the dressing treatment. By using the soft pad 20, similarly to Example 1, the surfaces of plural sheets of glass workpieces 31 were polished to prepare glass substrates. In this case, the load exerted by the soft pad 20 on the glass workpieces 31 and the product of the load (gf/cm$^2$) and the polishing period time (minutes) were set to be the same as those in Example 1. The obtained glass substrates had an average NRa value of 0.25 nm with an accompanying standard deviation of 0.05. The lifetime of the soft pad 20 was measured to be 125 hours.

EXAMPLE 3

The polishing portion 22 was formed of a polyurethane having a 100% modulus of 11.8 MPa, and thus the soft pad 20 was prepared to obtain the polishing pad of Example 3. Then, a soft pad which had the same Ra and Rmax values as that in Example 1 was obtained by applying the dressing treatment. By using the soft pad 20, similarly to Example 1, the surface of plural sheets of glass workpieces 31 was polished to prepare glass substrates. The obtained glass substrates gave the average NRa value of 0.20 nm with the accompanying standard deviation of 0.05. In this case, the product between the load exerted by the soft pad 20 to the glass workpieces 31 and the product between the load (gf/cm$^2$) and the polishing period of time (minutes) were set to be the same as those in Example 1. The lifetime of the soft pad 20 was measured to be 125 hours.

EXAMPLE 4

The polishing portion 22 was formed of a polyurethane having a 100% modulus of 11.8 MPa, and thus the soft pad 20 was prepared to obtain the polishing pad of Example 4. Then, a soft pad which had the same Ra and Rmax values as that in Example 1 was obtained by applying the dressing treatment. By using the soft pad 20, similarly to Example 1, the surfaces of plural sheets of glass workpieces 31 were polished to prepare glass substrates. The obtained glass substrates had an average NRa value of 0.25 nm with an accompanying standard deviation of 0.03. In this case, the polishing period of time was set such that the load exerted by the soft pad 20 on the glass workpieces 31 was made to be 55 gf/cm$^2$ (5.4 kPa) and the product between the load (gf/cm$^2$) and the polishing period of time (minutes) was 472. The lifetime of the soft pad 20 was measured to be 125 hours.

COMPARATIVE EXAMPLE 1

The polishing portion 22 was formed of a polyurethane having a 100% modulus of 12.7 MPa (130 kgf/cm$^2$), and thus the soft pad 20 was prepared to obtain the polishing pad of Comparative Example 1. Then, a soft pad 20 in which the Ra and Rmax values of the surface of the polishing portion 22 were respectively 7 μm or less and 50 μm or less was obtained without applying the dressing treatment. By using the soft pad 20, similarly to Example 1, the surfaces of plural sheets of glass workpieces 31 were polished to prepare glass substrates. The obtained glass substrates had an average NRa value of 0.20 nm with the accompanying standard deviation of 0.05. In this case, the load (gf/cm$^2$) exerted by the soft pad 20 on the glass workpieces 31 and the product between the load (gf/cm$^2$) and the polishing period of time (minutes) were set to be the same as those in Example 1. The lifetime of the soft pad 20 was measured to be 50 hours.

As a result of a comparison of the above described Example 1 with the above described Examples 2 to 4 and Comparative Example 1, it has been revealed that the lifetime becomes longer for the lower 100% modulus values irrespective as to whether the dressing treatment is applied or not. More specifically, when glass substrates were manufactured such that the average NRa value thereof was 0.25 nm or less with an accompanying standard deviation of 0.05 or less, the lifetime was least in Comparative Example 1, namely, 50 hours, and the lifetimes in Example 1 and Examples 2 to 4 were shown to be longer and to be twice or more the lifetime of Comparative Example 1.

As a result of a comparison between Example 2 and Example 3, the average NRa value for the glass substrates obtained in Example 3 where the dressing treatment was applied is found to be smaller than the average NRa value in Example 2, and thus it has been revealed that high quality glass substrates can be obtained by applying the dressing treatment. Additionally, as a result of a comparison between Example 3 and Example 4, it has been revealed that by raising the load exerted by the soft pad 20 on the glass workpieces 31 or by raising the product between the load (gf/cm$^2$) and the polishing period of time (minutes), the standard deviation for the obtained glass substrates can be reduced, so that glass substrates more stabilized in quality can be obtained.

It should be apparent to those skilled in the art that the present invention may be embodied in many other specific forms without departing from the spirit or scope of the invention. Particularly, it should be understood that the invention may be embodied in the following forms.

The polishing treatment is not constrained to be separated into two stages broadly, but may be separated into three or more stages. In such a scheme, more precise polishing to be carried out in the later stage steps can yield glass substrates of further higher quality.

For the purpose of meeting impact resistance, vibration resistance, heat resistance and the like required for data recording media, chemical reinforcement treatment may be applied to the glass workpieces after polishing. The chemical reinforcement, as referred to here, means a treatment in which the monovalent metal ions such as lithium ions and sodium ions are replaced with monovalent metal ions that are respectively larger in ionic radius than these ions, such as sodium ions and potassium ions. Additionally, herein is meant a treatment in which the surface of the glass substrate is chemically reinforced by applying compressive stress to the surface thereof. The chemical reinforcement is actually conducted by soaking the glass substrate in a chemical strengthening salt that is molten by heating for a predetermined time.

In the embodiments, the polishing treatment is conducted by use of a batch type polishing apparatus, but without being restricted to this type, the polishing treatment may be conducted by means of a single substrate processing type polishing apparatus that polishes sheets of glass substrate one-by-one.

In the respective examples, the polishing portion 22 was formed of a polyurethane foam, but foams made of synthetic resins such as olefinic resin and acrylic resin may be used so long as the foams are 1.8 MPa (120 kgf/cm$^2$) or less in 100% modulus.

Therefore, the present examples and embodiments are to be considered as illustrative and not restrictive and the invention is not to be limited to the details given herein, but may be modified within the scope and equivalence of the appended claims.

The invention claimed is:

1. A polishing pad for precise polishing of the surface of a lapped glass workpiece for use in data recording media, the polishing pad comprising:

a base and a polishing portion laminated on the surface of said base and contacting the surface of the glass workpiece when polishing the glass workpiece;

said polishing portion being formed of a foam made of a synthetic resin having a 100% modulus of 11.8 MPa or less; and the maximum height, Rmax, of the surface roughness of said polishing portion, being 70 μm or less.

2. The polishing pad according to claim 1, wherein the polishing pad is subjected to a dressing treatment with a load of 25 to 45 gf/cm$^2$ for 10 to 40 minutes.

3. The polishing pad according to claim 1, wherein the period of time for said polishing portion to reach its durability limit is 125 hours or more.

4. The polishing pad according to claim 1, wherein the surface roughness, Ra, of said polishing portion is 7 μm or less.

* * * * *